United States Patent [19]

Adam

[11] 4,456,078

[45] Jun. 26, 1984

[54] EARTH BORING METHOD AND APPARATUS

[76] Inventor: Arthur J. L. Adam, 400 Regent Ave. W., Transcona, Manitoba, Canada, R2C 1R6

[21] Appl. No.: 199,998

[22] Filed: Oct. 23, 1980

[51] Int. Cl.[3] ..... E21B 11/00

[52] U.S. Cl. ..... 175/20; 175/53; 175/403; 175/408

[58] Field of Search ..... 175/20, 53, 62, 401, 175/391, 403, 404, 406, 317, 318; 405/138, 184

[56] References Cited

U.S. PATENT DOCUMENTS

| | | | |
|---|---|---|---|
| 1,445,289 | 2/1923 | Bron | 175/403 UX |
| 1,993,365 | 3/1935 | Engelbright et al. . | |
| 2,234,451 | 3/1941 | Ransom | 175/401 |
| 2,575,975 | 11/1951 | Robbins | 175/391 |
| 2,664,273 | 12/1953 | Merrick | 175/20 |
| 2,693,345 | 11/1954 | Martin . | |
| 2,843,362 | 7/1958 | Degen . | |
| 2,960,312 | 11/1960 | Kandle | 175/391 X |
| 2,979,141 | 4/1961 | Kandle | 175/19 |
| 3,094,179 | 6/1963 | Lines | 175/408 |
| 3,344,876 | 10/1967 | Turner | 175/401 |
| 3,482,641 | 12/1969 | Atkins et al. | 175/53 |
| 3,611,567 | 12/1961 | Turner | 175/53 |
| 3,754,608 | 8/1973 | Baille | 175/53 |
| 3,987,857 | 10/1976 | Atkins | 175/53 |

FOREIGN PATENT DOCUMENTS 652419 11/1962 Canada .

*Primary Examiner*—William F. Pate, III
*Attorney, Agent, or Firm*—Robert Scobey

[57] ABSTRACT

There is described a new and improved method and apparatus for boring subterranian holes between horizontally spaced locations, comprising a broaching head having a first trailing and a second leading end for cutting a bore hole through the ground, a rod string releasably connectible to the first end thereof for pushing the broaching head through the ground; a guiding head cooperating with the broaching head for guiding the movement of the broaching head between the horizontally spaced locations, and extruders to extrude the incised core of the bore. The broaching head is pushed between the locations to cut a core, which passes through the head, by forming first and second coaxial incisions, whereby subsequent removal of the core is facilitated.

57 Claims, 20 Drawing Figures

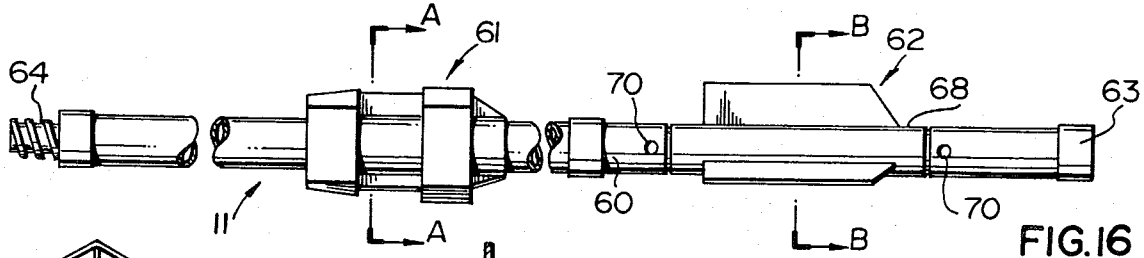
FIG. 16
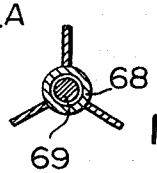
FIG. 18
FIG. 17
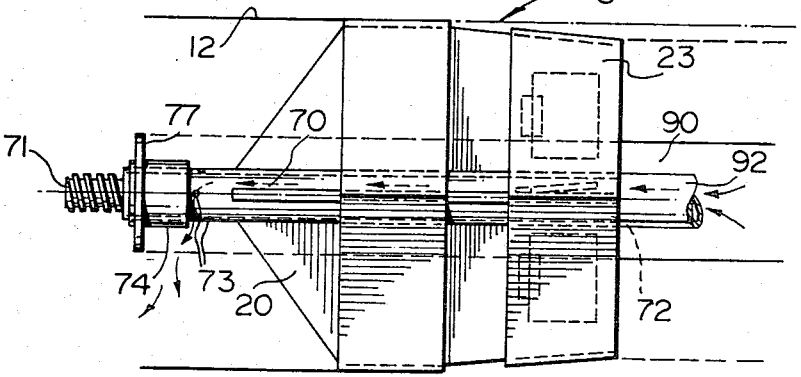
FIG. 19
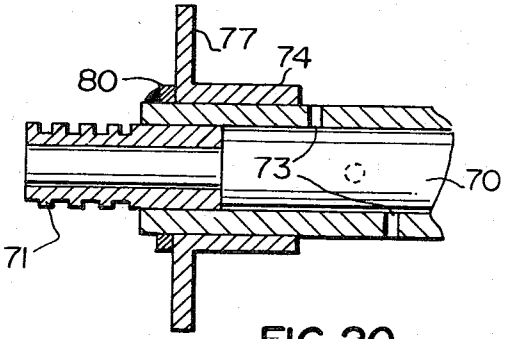
FIG. 20

EARTH BORING METHOD AND APPARATUS

BACKGROUND OF THE INVENTION

The present invention relates to an earth boring apparatus and more particularly to an apparatus and method for boring substantially horizontal holes of various sizes between two spaced apart trenches.

Earth boring apparatus of the present type find application in the laying of pipes, conduits, cables or virtually any other type of underground transmission medium normally laid in a trench dug in the ground. When laying such transmission media over any distance, various surface installations such as roads, driveways, bridges or rail lines to name but a few are usually encountered. To avoid disruption of these installations and the expense of broaching them to lay the line, it has proven desirable and indeed necessary in certain cases to be able to bore a hole of adequate size beneath the surface installation to receive the transmission line. Typically, a trench or operating pit is dug on either side of the surface installation, the pit being of adequate size to receive the necessary boring apparatus at either end of the hole. A pilot hole or coring apparatus is then "shot" from one pit to the other to form and align the hole so formed with the incoming transmission line, which will, for the purposes of illustration, be hereinafter referred to as a pipe. A typical method and apparatus by which such boring has been accomplished to date is illustrated in Canadian Pat. Nos. 760,841, 773,006 and 779,148 to Atkins which issued in 1967. Atkins teaches an apparatus and a four step procedure for performing the bore holes. Firstly, a pilot hole is shot from one trench to the other using a pilot hole cutter. Power is supplied by means of a hydraulic power head situate in one trench. The pilot hole is then expanded by pushing spherical expanders having diameters greater than that of the cutter through the hole to compress the surrounding soil. Once through, the pilot hole cutter and expanders are removed and an earth cutter is affixed to the end of the rod string. The earth cutter is then drawn back, being guided by the pilot hole, to incise a bore hole. The direction of movement of the cutter is then reversed, that is, it is pushed back towards the end of the hole, to extrude the plug. A relatively small downturned flange on the trailing edge of the cutter is intended to score the core to reduce friction between it and the surrounding wall when the hole is being incised and to grip the core when the earth cutter is pushed back to thereby extrude the core.

It will be apparent to those skilled in the art that this manner of forming bore holes suffers from a number of disadvantages. For one, a multiplicity of steps is required, adding complexity, prolonging the operation and increasing the wear and tear on the machinery and hence increasing the risk that breakdowns or problems will be encountered. A prolonged procedure results of course in increased costs.

Another disadvantage is that the pilot hole cutter is easily deflected by stones or other obstructions encountered in the soil, necessitating the use of a relatively unreliable procedure whereby a new hole is shot from the opposite trench using a corrector head. The corrector head must be propelled by its own source of power and is shot in the hope of linking up with the partially formed pilot hole. This is obviously an expensive and time consuming procedure.

A further disadvantage lies in the fact that additional equipment is required, including pilot hole expanders of different sizes and shapes, retaining means to hold the expanders in place, a pilot hole cutter and a winch for drawing and guiding the earth cutter back through the bore to extrude the plug.

Yet another disadvantage is that the small downturned flange on the earth cutter is often inadequate to exert the forces necessary to cause extrusion of the plug. This will occur when the plug is composed of soil which is either somewhat unconsolidated, in which case the soil merely flows through the cutter without being extruded, or is a very viscous, heavy medium such as clay, in which case the small flange will be unable to get a sufficient grip on the plug to overcome its frictional engagement with the bore hole wall. In the result, the cutter will merely rescore the surface of the plug while sliding ineffectually back over it. Further, if only a portion of the core at a time is to be extruded, as is often the case, the small flange is relatively ineffective in "biting" off a piece of the core for extrusion.

SUMMARY OF THE INVENTION

It is an object of the present invention to provide an earth boring method and apparatus which obviates and mitigates from the aforementioned disadvantages and difficulties of the prior art.

It is also an object of the present invention to provide an apparatus for boring subterranian holes between horizontally spaced points having a cutting or broaching head for cutting a bore hole through the ground, the cutting head cooperating with a guiding head for guiding the cutting head between the horizontally spaced points.

It is a further object of the present invention to provide a method for boring holes in the ground between horizontally spaced locations by pushing a cutting head between the locations to cut a core. First and second coaxial incisions are formed to facilitate the subsequent removal of the core.

It is a further object of the present method to provide a broaching head having first and second circumferential ground-cutting vanes spaced from and extending around the central shaft of the head. The ground cutting vanes may be of different diameters so as to incise two coaxial bores.

It is yet a further object of the present invention to provide a new guiding head for attachment to the broaching head, the guide head including a plurality of radial fins disposed about a central shaft to provide directional stability to the broaching head as it is being pushed through the ground.

According to the present invention, then, there is provided an apparatus for boring subterranian holes between horizontally spaced locations, comprising: broaching means having a first trailing and a second leading end for cutting a bore hole through the ground; rod means releasably connectible to the first end for pushing the broaching means through the ground; guide means cooperating with said broaching means for guiding the movement of the broaching means between horizontally spaced locations; and extruding means to extrude the incised core of the bore.

According to a further aspect of the present invention, there is also provided a method of boring holes in the ground between horizontally spaced locations including the steps of: pushing a broaching head between the locations to cut a core, which passes through the head, by forming first and second coaxial incisions, whereby subsequent removal of the core is facilitated; and guiding the broaching head between said spaced locations during the cutting of the core, and extruding the core to form the hole.

According to yet another aspect of the present invention, there is further provided a broaching head, comprising: a central portion; a plurality of radial ground-cutting vanes extending from the central portion; and first and second circumferential ground-cutting vanes spaced from and extending around the central portion and coaxial therewith; the first and second circumferential ground-cutting blades being unequally spaced from the central portion.

According to yet another aspect of the present invention, there is further provided a guide head for attachment to a broaching head, comprising: a central portion adapted at one end thereof for releasable connection to the broaching head; and a plurality of radial fin members disposed about the central portion to provide directional stability during the pushing of the broaching head through the ground.

BRIEF DESCRIPTION OF THE DRAWINGS

Embodiments of the present invention will now be described in greater detail and will be better understood when read in conjunction with the following drawings in which:

FIG. 16 is an elevational view of a coring tool for use with a method illustrated in FIGS. 14 and 15;

FIG. 17 is a cross-sectional view along line A—A of FIG. 16;

FIG. 18 is a cross-sectional view along line B—B of FIG. 16;

FIG. 19 is an elevational view of an embodiment of the broaching head of FIG. 5 including a venting mechanism;

FIG. 20 is a cross-sectional view of the venting apparatus of FIG. 19.

DESCRIPTION OF PREFERRED EMBODIMENTS

Figure 1:
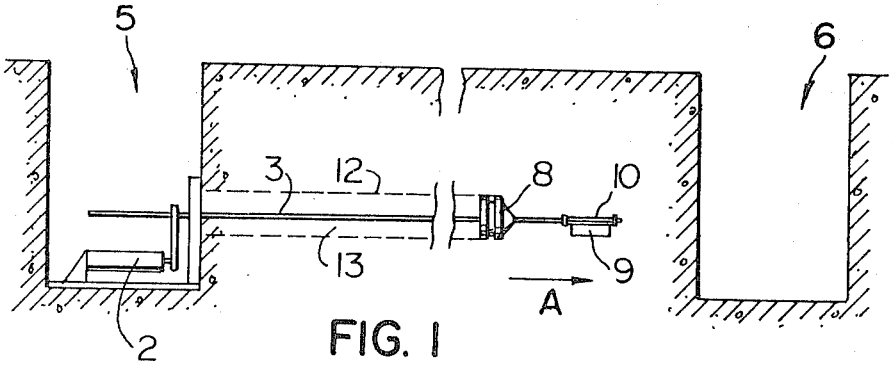
FIGS. 1 to 4 illustrate the formation of a bore hole in a manner to be described herein.
Figure 2:
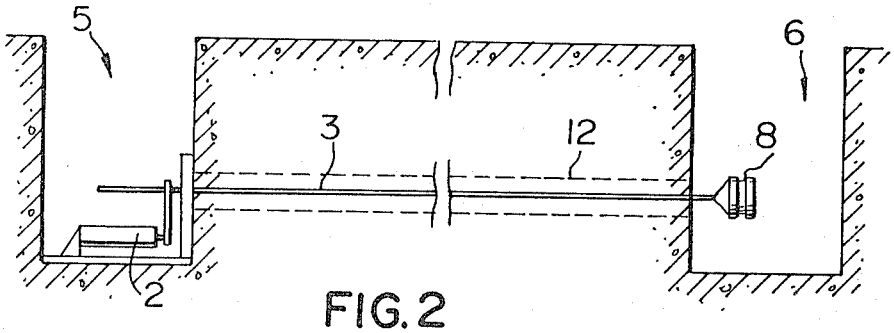
Figure 3:
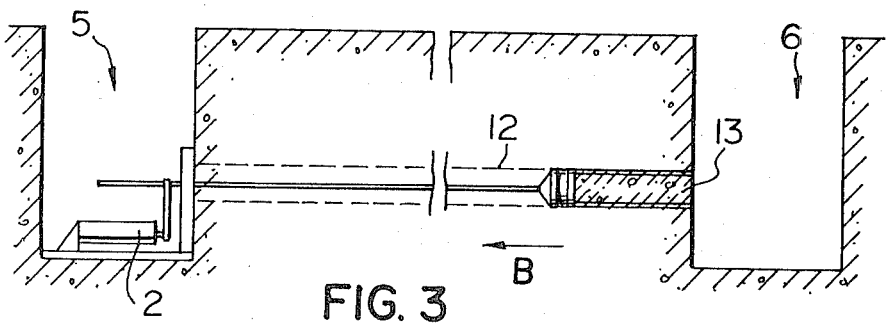

Referring now to FIGS. 1 to 4, there is illustrated an earth coring procedure according to an embodiment of the present invention. Operating trenches or pits 5 and 6 are formed on either side of a surface installation (not shown) such as a road. Into pit 5 is placed a power head 2 of any suitable type although very good results are obtained using an hydraulic apparatus. The hydraulic pump itself may be mounted on a truck with merely the hydraulic lines being led to the power head in the pit. The power head actuates a string of rods 3 connected at their leading end to one end of a broaching head 8. When power is applied, broaching head 8 is pushed through the ground in the direction of arrow A towards pit 6 to cut or incise a bore 12. To ensure that head 8 remains on target when proceeding toward pit 6, a guiding head 10 is affixed to the leading end of head 8. Guiding head 10 is provided with a plurality of radiating fins 9 to provide directional stability so that head 8 runs true when being shot from pit 5 to pit 6. Further details of guiding head 10 will be provided below. It will be appreciated that when the guide head and the broaching head are used in the combination suggested, the need to both form and then expand a pilot hole is eliminated. Further, the bore hole itself is actually incised with the first shot of the apparatus between the operating pits, streamlining the process considerably.

Upon emergence into pit 6, guide 10 is removed and broaching head 8 is reversed in orientation and reaffixed to rod string 3. The direction of drive of the power head is reversed and head 8 is drawn back into the bore hole incision in the direction shown by arrow B in FIG. 3. Head 8 may be withdrawn all or part way back towards pit 5, the actual length of the withdrawal depending upon the length of the bore and the rigidity and weight of the soil forming plug 13. When head 8 has been withdrawn an appropriate distance, the direction of thrust exerted by power head 2 is reversed as shown by arrow C in FIG. 4, whereupon head 8 is effective in a manner to be described below to cause the extrusion of plug or core 13 into pit 6. The extruded material may be either manually or mechanically removed from the pit. This process is repeated, if necessary, until all of plug 13 has been ejected.

Figure 5:
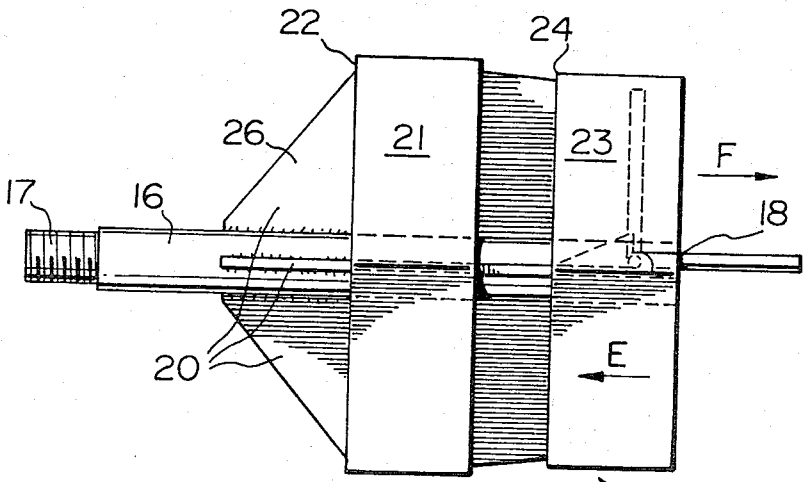
FIG. 5 is a partially sectional, side-elevational view of the broaching head as described herein.

Referring now to FIG. 5, broaching head 8 comprises a central rigid shaft 16 adapted at both ends 17 and 18 thereof for attachment to either one end of rod string 3 or to guide 10. The ends may be either screw threaded or adapted for the insertion of a locking pin or a combination of both.

Radiating outwardly from shaft 16 are a plurality of vanes 20 which may be welded to the shaft. Any number of radial vanes 20 may be provided but it will be appreciated that the greater the number of vanes, the greater will be the power requirements necessary to push the head through the ground. It has been found that the provision of three vanes 20 affords an optimal combination of strength versus push resistance. Each of vanes 20 is attached proximal to end 17 of shaft 16 and projects therefrom radially outwardly and rearwardly towards end 18 to a point of connection to the leading edge 22 of peripheral vane 21. Vanes 20 then continue rearwardly in a direction parallel to shaft 16 until they emerge at the trailing edge of vane 21, from which point the outer edges of vanes 20 taper inwardly towards shaft 16 to a point of connection with leading edge 24 of peripheral vane 23. This inward tapering of the vanes is due to the fact that the diameter of vane 21 exceeds that of vane 23. Vanes 20 then continue on in a direction parallel to shaft 16, terminating at the trailing edge of vane 23. Radial vanes 20 thus define planar surfaces connected to and supporting peripheral vanes 21 and 23. Leading edges 22 and 24 of vanes 21 and 23, respectively, and the leading edges 26 of vanes 20 may be beveled to define sharpened cutting edges to facilitate the passage of head 8 through the ground. It will be appreciated that in addition to their cutting and support functions, the vanes, and particularly vanes 20, cooperate with guide fins 9 to maintain head 8 on a true and correct course towards the target destination in pit 6.

Figure 6:
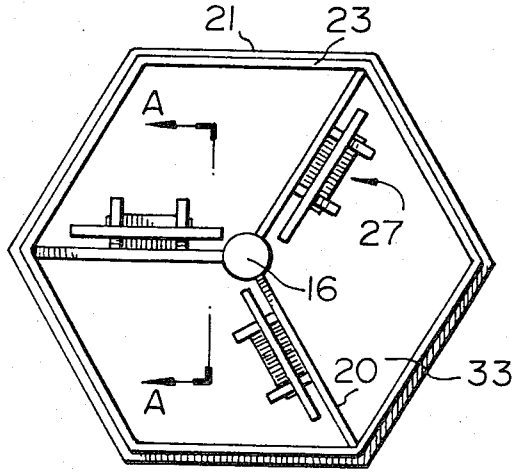
FIG. 6 is a front-elevational view of the broaching head of FIG. 5.
Figure 8:
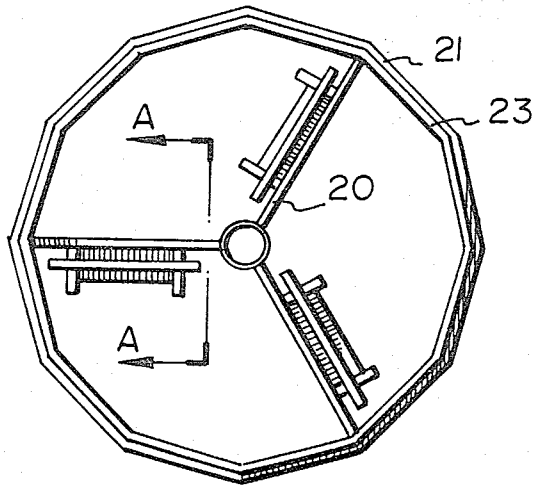
FIG. 8 is a front-elevational view of the broaching head of FIG. 7.
Figure 7:
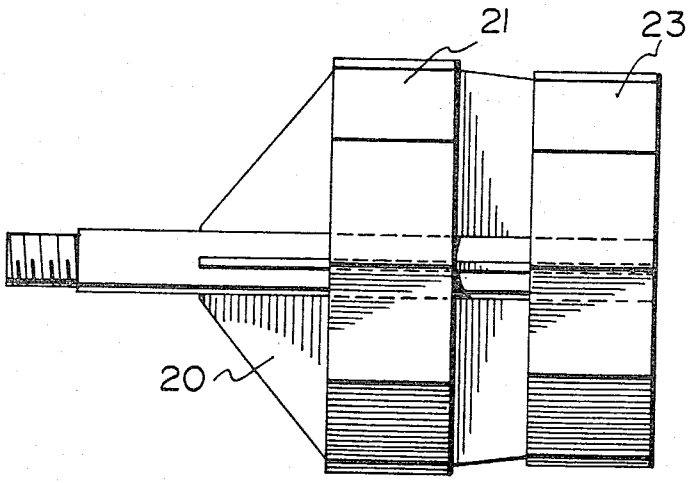
FIG. 7 is a side-elevational view of another embodiment of the broaching head of FIG. 5.

With particular regard to FIG. 6, peripheral vanes 21 and 23 are illustrated as being hexagonal in shape although the actual shape may be varied to include cylinders, squares or other appropriate shapes as may be necessary to form the shape and size of bore required. It has been found that for the boring of holes having diameters of five inches or less, a hexagonally shaped vane provides good results, whereas for holes in excess of 5 inches in diameter, the dodecahedral shape illustrated in FIGS. 7 and 8 offers good results. Again, the actual diameter of head 8 will be chosen depending upon the requirements of the job at hand.

Because the diameter of vane 21 is greater than that of vane 23, two concentric cuts will be incised, one slightly larger than the other. In the embodiment illustrated, the outer surface of vane 23 is coplanar with the inner surface of vane 21, as can be clearly seen in FIG. 6. Accordingly, a layer of soil of a thickness approximately equal to the thickness of vanes 21 and 23 together will be displaced or squeezed from around core 13 by the action of the vanes. Core 13 is then spaced from the wall of bore 12 and friction therebetween is substantially reduced, greatly facilitating the extrusion of the core.

It is also contemplated that the spacing of vanes 21 and 23 from shaft 16 may be such that the inner and outer surfaces thereof, respectively, are not coplanar but are spaced apart. Soil passing between the vanes, then, will be squeezed or otherwise displaced to again result in the formation of either a space between core 13 and the surrounding walls or an annulus of soil therebetween, again having the effect of facilitating the extrusion of the core and lessening the compressive forces on rod 3.

It is further contemplated that vane 23 may be inclined slightly towards end 18 of shaft 16 as shown in FIGS. 16 and 19. This has the effect of causing the compression or compaction of core 13 so that again there is less friction to overcome when extruding the core. Further, because the core is thusly isolated from the surrounding soil, the compressive forces exerted on rod 3 are substantially reduced. Excellent results have been obtained by tapering vane 23 by ¼ inch from front to back. It will be appreciated that the tapering of vane 23 may be used in the alternative to decreasing the diameter of vane 23 relative to vane 21.

Figure 9:
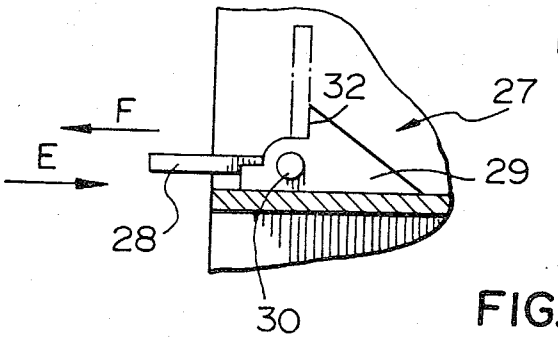
FIG. 9 is a schematical representation of a gate mechanism affixed to the broaching head of FIGS. 5 to 8.

Referring to FIGS. 6 and 9 together, radial vanes 20 are spaced at equidistant points about shaft 16 such that an angle of 120° is defined between each adjacent pair of vanes. Provided on each of vanes 20 at a point intermediate shaft 16 and peripheral vane 23 is a gate assembly 27 comprising a swingable gate 28 pivotally mounted on a wedge-shaped mount 29 by means of a hinge pin 30 rotatably received into mount 29. Alternatively, gate 28 may be pivotally mounted about hinge pin 30, with the latter fixedly received into mount 29.

In operation, gate 28 is disposed to open, as is illustrated by the solid lines in FIG. 9, as head 8 is pushed or pulled in the direction indicated by the arrow marked E. This allows for the passage of soil through the head without excessive resistance. It will be appreciated, however, that notwithstanding that the gates are disposd to minimize frictional drag, they are nevertheless useful to help compress the core somewhat or, in the case of such hard materials as consolidated tills, to help crumble it for easier extrusion. Further, during extrusion of the core, the gates prevent the core from passing through head 8, thereby lending directional stability to the rearward thrust of the broaching head, limiting the tendency of the peripheral vanes to nibble at or perhaps catch the surrounding walls during the extrusion process. This added stability provided by the core virtually eliminates the need for a winch in assisting the extrusion process.

Figure 4:
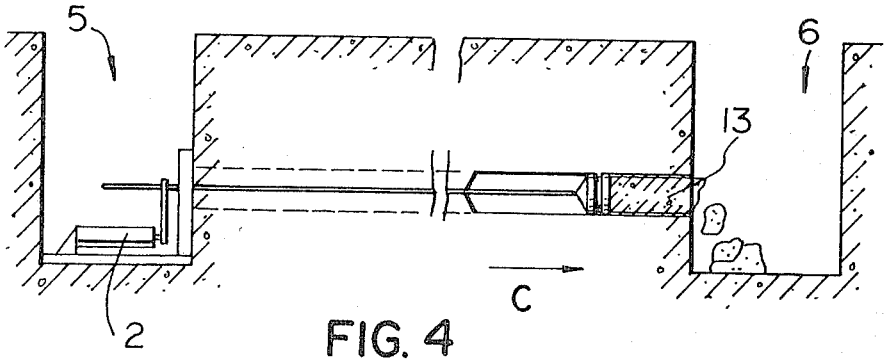

When the broaching head is pushed or pulled in the direction indicated by arrows F in FIGS. 5 and 9, the gates catch the soil and are pivoted into the closed position illustrated by the phantom lines in FIG. 9. The gate is held in this position by the action of gate stop 32 integrally formed with mount 29. Depending upon the size of the gate, then, the open spaces 33 defined between adjacent pairs of vanes 20 and peripheral vane 23 are wholly or partially closed up such that when head 8 is pushed towards pit 6, it acts as a ram to extrude the core as illustrated in FIG. 4, biting off a a piece of the core, if necessary.

Figure 11:
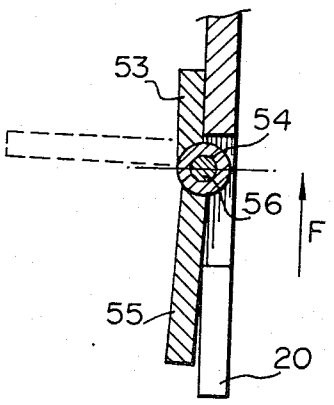
FIG. 11 is a sectional view of the gate mechanism of FIG. 10 taken along line A—A thereof.
Figure 10:
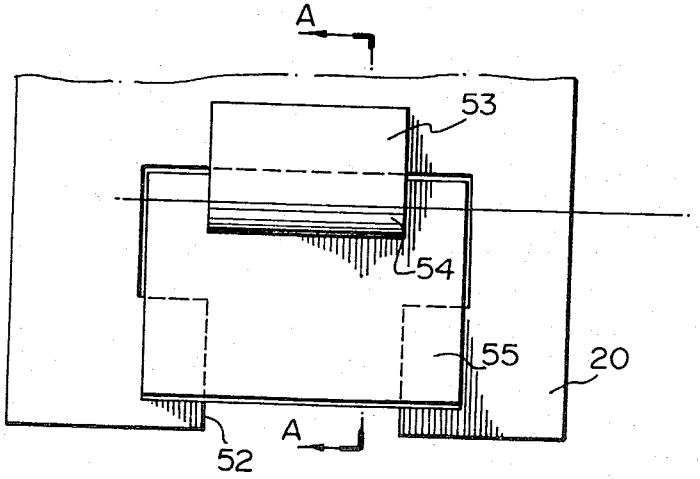
FIG. 10 is a plan view of an alternative gate mechanism.

With reference to FIGS. 10 and 11, there is illustrated an alternative method of mounting the gate which considerably reduces the exposed profiles thereof and, correspondingly, their frictional resistance to movement through the ground. A T-shaped opening or slot 52 is formed into the trailing end of radial vanes 20. A hinge plate 53 having a hinge pin socket 54 formed at one end thereof is securely fixed to vane 20 adjacent the wide end of slot 52 so that socket 54 projects into the slot. Gate 55 is then pivotally mounted to hinge plate 53 by means of a hinge pin 56 rotatably received into socket 54. Accordingly, gate 55 will project outwardly and rearwardly from slot 52 to present a very limited profile when head 8 is being pushed or pulled in the direction denoted by arrow F in FIG. 11. Of course, when the direction of movement is reversed, the outwardly projecting end of gate 55 will catch the soil and be pivoted into the closed position thereof denoted by the phantom lines in FIG. 11.

If plug 13 is composed of heavy, viscous or otherwise difficult to displace soils such as clay, it may be desirable to form the gates to close up only a small portion of space 33. When pressure is applied to head 8 via power unit 2, the smaller gates will be effective to gouge out a portion of the core, reducing its mass until the remaining portion of the plug can be completely removed by a repetition of the step illustrated in FIG. 4.

In the event that very large bore holes are required, successively larger broaching heads 8 can be used until the desired size of bore is attained.

It will be appreciated that other means of extruding the core are contemplated. By way of example only, head 8 may be formed without gates but upon emergence into pit 6, the guiding head 10 may be removed to be replaced by an extruding attachment which may take the form of a third peripheral vane supported by radial vanes having gate means mounted thereon. This assembly is then drawn into the incision and is used to extrude the core in the manner aforesaid.

Similarly, both head 8 and guide 10 may be removed and an extruding attachment such as that just described may be attached directly to rods 3 for the purpose of extruding the core.

The broaching head can be fabricated from any suitable material, e.g. high strength steel.

Figure 12:
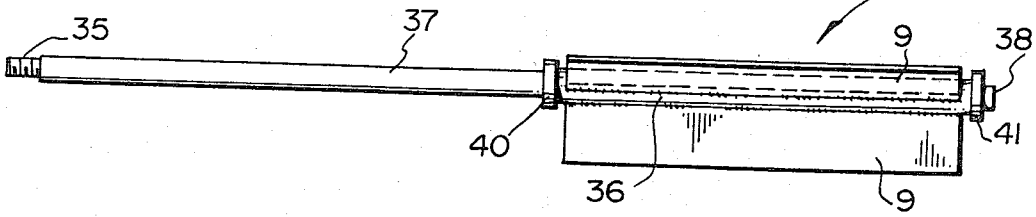
FIG. 12 is a side-elevational view of a guiding head for attachment to the broaching head of FIGS. 5 to 8.

Referring now to FIG. 12, numeral 10 generally designates the guiding head affixed at end 35 thereof to end 17 of the broaching head when shooting a hole as illustrated in FIG. 1. Fins 9 are fitted to a tube 36 by welding or any other suitable method. Tube 36 fits concentrically over rod 37 and is held in place adjacent leading end 38 by means of retaining rings 40 and 41. The advantage to be gained by utilizing concentric tube 36 is that should the fins become damaged, the tube can be removed and replaced with another tube having undamaged fins attached, thus avoiding downtime which would otherwise be required for repairs. A further advantage to be gained is that rings 40 and 41 may hold tube 36 rotatably in place about rod 37. Accordingly, upon encountering certain kinds of obstructions such as smaller rocks and the like, the tube can rotate to allow for the passage of the obstructed fin past the rock without causing a deflection of the guiding head itself. This advantage is particularly important when shooting relatively long holes for then even a small deflection could result in a significant departure from the intended trajectory. The fins may, of course, be affixed directly to rod 37.

The leading edges of the fins may be beveled to facilitate soil penetration.

Figure 13:
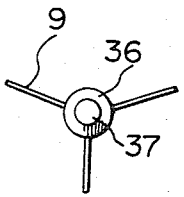
FIG. 13 is a front-elevational view of the guiding head of FIG. 12.

Referring now to FIG. 13, fins 9 are disposed radially about rod 37 and are spaced at equidistant intervals about tube 36. Although more fins than are illustrated may be used, it has been found that the use of three of such fins offers excellent directional stability for the amount of resistance offered. Obviously, the more fins employed of a size equivalent to those illustrated, the greater will be the resistance to movement and of course the power required to cause that movement. Further, the use of more fins would result in a closer spacing thereof about tube 36, making it more difficult to bypass minor obstacles due to the decreased latitude for rotation of the tube to overcome that obstacle.

Figure 14:
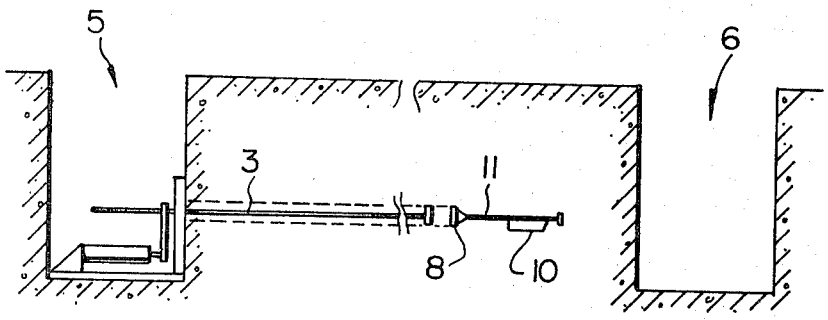
FIGS. 14 and 15 illustrate an alternative method of forming a bore hole in a manner to be described herein.
Figure 15:
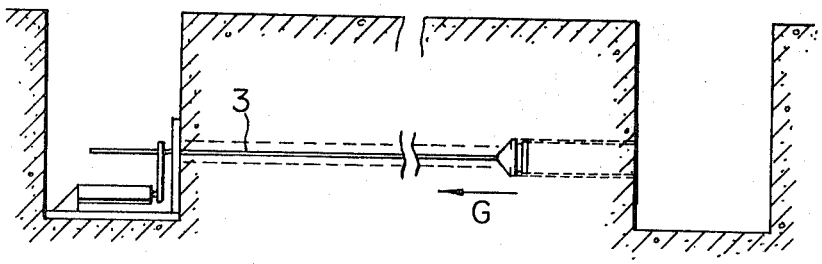

An equally advantageous method and apparatus for forming bore holes is illustrated in FIGS. 14 and 15 wherein broaching head 8 and guide 10 may be affixed onto a single rod to constitute an integral tool 11 for the formation of holes of four to five inches in diameter or less. Upon emergence into pit 6, and assuming that a bore of four to five inches is all that is required, as is often the case, the incised core may be extruded by a gated extrusion assembly or a conventional ram, it being appreciated that the physical dimensions of a broaching head of this size are too limited for the provision of gates as described above. In the event that larger holes are required, particularly for such utility installations as water or sewerage lines, integral tool 11 is removed and replaced by a broaching head of larger dimensions. As described above, the larger broaching head is reversed in orientation for connection to rod string 3. The head is then drawn back into the ground in the direction shown by arrow G in FIG. 15 to incise a co-axial core to that formed by the passage of the smaller broaching head. By reversing the thrust of the power head, head 8 acts as a ram to extrude the core as described above. It will be appreciated that the previous passage of the smaller head including a tapered trailing vane such as shown in FIG. 16 forms a compacted annulus of soil about rod string 3, thereby reducing substantially the compressive forces otherwise exerted on the rod by the surrounding soil. Similarly, the larger broaching head may also include a tapered vane 23 for compacting the larger core during the cutting thereof. Accordingly, this method is particularly advantageous when boring at greater depths or over longer distances or through soils such as clays which are likely to render the passage of the rod relatively difficult due to their adhesive tendencies.

In the event that very large holes are required, successively larger broaching heads are used until the desired size of hole is attained.

Referring to FIG. 16, there is illustrated therein an integral tool 11 comprising a broaching head 61 and a guide head 62 formed about a central shaft 60. A blunt cap 63 is fitted about the leading end of shaft 60, it having been found that greater directional stability is obtained using a blunted instrument, and a buttress thread 64 is fitted into the trailing end of the shaft for connection to rod string 3. The basic construction of broaching head 61 is substantially identical to broaching head 8 described above with respect to the embodiment of FIG. 5. Head 61 may, however, comprise a hollow central shaft 67 as shown in FIG. 17 which fits concentrically about shaft 60 for secure attachment thereto. The radial vanes of the head may also be affixed directly to shaft 60 to project therefrom. As is well known in the art, it is often desirable to turn the rods in the ground by $\frac{1}{4}$ to $\frac{1}{2}$ a turn with the insertion of each 5 to 10 feet of rod into the ground. To facilitate this technique, central shaft 67 may alternatively be slidably received onto rod 60 to be freely rotatable thereabout.

As described above, the trailing peripheral vane of head 61 may be smaller in diameter than the leading peripheral vane and may be tapered rearwardly to compress the core during the cutting thereof.

Guiding head 62 is substantially identical to guiding head 10 described above with reference to FIG. 10. Guide 62 may be made rotatable about rod 60 is a number of ways although excellent results are obtained in the manner illustrated in FIGS. 16 and 18. A section of tubing 68 of the same stock as shaft 60, which is hollow, is rotatably fitted about a spindle member 69, the ends of which project beyond the limits of tube 68. The projecting ends of the spindle are received into the hollow core of shaft 60. The spindle is fixedly held in place by pins 70 or any other suitable method such as welds. In a preferred embodiment constructed by the applicant, the length of tool 11 is approximately five feet, the diameter of rod 60 is $1\frac{1}{2}$ to 2" and the diameter of head 61 is $4\frac{1}{2}$ inches.

It has been found that when coring holes of diameters in excess of $4\frac{1}{2}$ to 5 inches, and particularly during the core extrusion process thereof, a vacuum is created behind the broaching head as portions of the core are being extruded. Further, pressurization of the bore occurs when the head is drawn back in to extrude the next portion of the core, it being appreciated that the broaching head is usually packed with mud throughout the coring operations and is therefore relatively impermeable to the passage of air. These pressure variations greatly increase the load on power head 2 and can also create potential hazards to the operators. It has been known to happen tha soil packed into the broaching head has been violently ejected as the head is drawn back into the bore. Further, the vacuum induced upon core extrusion has been known to cause collapse of the surrounding walls.

To overcome this problem, a novel pressure release mechanism has been added to broaching head 8. With reference to FIG. 19, head 8, which is substantially identical to the head described above with reference to FIG. 5, is formed about a hollow shaft 70 having buttress threads 71 and 72 formed at each end thereof for connection to the rod string. Formed into the end of shaft 70 adjacent thread 71 are a plurality of air (or water) holes 73 spaced about the periphery thereof. The holes may be offset along the axial length of the shaft. A release valve 74 is slidably disposed above shaft 70 adjacent holes 73. Valve 74 is formed having a radial flange 77 formed thereon. Referring to FIG. 20, valve 74 is restrained in its movements towards thread 71 by stop 80 formed onto shaft 70. Radial vanes 20 restrain the movement of the valve in the opposite direction.

As head 8 is initially drawn back into the incision prior to extrusion of the core, flange 77 is engaged by the soil and is moved towards end 72 of the shaft to cover breathing holes 73 to prevent their clogging. It will be appreciated that the flange is also effective to enlarge the hole formed by the rod string during the first shot of the apparatus into pit 6 thereby forming an expanded air passage 90 through the core. Upon reversal of the thrust to head 8, the action of the soil against the flange results in valve 74 being forced against stop 80, thereby exposing holes 73. As the broaching head is thrust rearwardly to extrude the core portion, air flows through the enlarged opening 90 in the core, through rod 70 and holes 73 into the cavity now being vacated by the extruding process, preventing the formation of a vacuum. It has been found that the amount of energy required to extrude the core is thusly substantially reduced.

With certain types of soil it can be anticipated that the core will be readily deformed during the extrusion thereof to block the air passage formed by flange 77. To avoid this problem, a section of hollow tubing 92 of a length greater than that of the core section may be affixed to thread 72 to provide an extended air passage not subject to blockage.

As mentioned previously, the broaching head is typically full of mud so that when it is next drawn into the bore to extrude the next core section, a potentially dangerous pressurization of the bore will occur. However, because valve 74 remains in the open position until flange 77 contacts the unextruded portion of core 13, holes 73 remain uncovered so that air may escape from the bore and the pressurization thereof is avoided.

What is claimed is:

1. An apparatus for non-rotatively forming subterranean holes between horizontally spaced locations in the absence of a pilot hole previously formed between said spaced locations, comprising:

broaching means having a first trailing and a second leading edge for cutting a core of earth;

rod means releasably connectible to said first end for pushing said broaching means through the ground to cut said core of earth;

guide means disposed forwardly of said broaching means for initial penetration of the earth in the direction of said pushing to guide the movement of said broaching means between said horizontally spaced locations; and extruding means to extrude said core of earth.

2. The apparatus of claim 1 wherein said extruding means are affixed to said broaching means.

3. The apparatus of claim 2 wherein said broaching means are releasably connectible at said second end thereof to said rod means for core extruding movement of said broaching means in said incised hole.

4. The apparatus of claim 3 wherein said broaching means comprise a central member adapted for attachment to said rod means and to said guide means, first and second peripheral vanes circumferentially disposed about said central member, said first vane being located forwardly relative to said second vane when said broaching means are being pushed through the ground, the diameter of said first vane being larger than that of said second vane, and a plurality of radial vanes extending between said central member and said peripheral vanes to support said peripheral vanes and to radially cut said core of earth as said broaching means are pushed through the ground.

5. The apparatus of claim 4 wherein said extruding means comprise gate means mounted on said radial vanes, said gate means being adapted to open during the pushing of said broaching means through the ground and to close during the extruding movements of said broaching means, whereupon said gate means close at least part of an area defined between adjacent pairs of radial vanes and said peripheral vane to facilitate the extrusion of said core of earth.

6. The apparatus of claim 5 wherein said guide means include a rod member adapted at one end thereof for attachment to said broaching means and to extend forwardly thereof, and a plurality of radial fin members disposed about said rod member to provide directional stability during the pushing of said broaching means through the ground.

7. The apparatus of claim 6 wherein said rod member is adapted for attachment to the second end of said broaching means.

8. The apparatus of claim 7 wherein said fin members are rotatable about said rod member.

9. The apparatus of claim 1 wherein said broaching means and said guide means are disposed in spaced relationship about a common central member adapted at one end thereof for attachment to said rod means, said broaching means comprising first and second peripheral vanes circumferentially disposed about said shaft, said first vane being located forwardly relative to said second vane when said broaching means are being pushed through the ground, and a plurality of radial vanes extending between said central member and said peripheral vanes to support said peripheral vanes and to cut said core of earth as said broaching and guide means are pushed through the ground; said guide means being disposed forwardly of said broaching means and comprising a plurality of radial fin members disposed about said central member to provide directional stability during the pushing of said broaching means through the ground.

10. The apparatus of claim 9 wherein broaching means and said fin members are rotatable about said common central member.

11. An apparatus for non-rotatively forming subterranian holes between horizontally spaced locations, comprising:

broaching means having a first trailing and a second leading end for cutting a core of earth;

rod means releasably connectible to said first end for pushing said broaching means through the ground to cut said core of earth;

guide means cooperating with said broaching means for guiding the movement of said broaching means between said horizontally spaced locations; and extruding means to extrude said core of earth, wherein said extruding means are affixed to said broaching means, and said broaching means are releasably connectible at said second end thereof to said rod means for core extruding movement of said broaching means in said hole, said broaching means comprising a central member adapted for attachment to said rod means and to said guide means, first and second peripheral vanes circumferentially disposed about said central member, said first vane being located forwardly relative to said second vane when said broaching means are being pushed through the ground, the diameter of said first vane being larger than that of said second vane, and a plurality of radial vanes extending between said central member and said peripheral vanes to support said peripheral vanes and to radially cut said core of earth as said broaching means are pushed through the ground.

12. The apparatus of claim 11 wherein said central member is hollow and has formed therein forwardly of said first peripheral vane at least one aperture for the passage of a fluid.

13. The apparatus of claim 12 including collar means slidably disposed about said central member to alternately open and close said aperture during said core extruding movements of said broaching means.

14. The apparatus of claim 13 wherein said collar means have formed thereon radially extending ground engaging means to cause said collar means to slide along said central member to alternately open and close said aperture.

15. The apparatus of claim 11 wherein said extruding means comprise gate means mounted on said radial vanes, said gate means being adapted to open during the pushing of said broaching means through the ground and to close during the extruding movements of said broaching means, whereupon said gate means close at least part of an area defined between adjacent pairs of radial vanes and said peripheral vane to facilitate the extrusion of said core of earth.

16. The apparatus of claim 12 wherein said peripheral vanes are hexagonally shaped for bore hole diameters ranging from 2 to 5 inches.

17. The apparatus of claim 12 wherein said peripheral vanes are dodecahedrally shaped for bore hole diameters in excess of 5 inches.

18. The apparatus of claims 16 or 17 wherein said radial and peripheral vanes are provided with beveled cutting edges.

19. The apparatus of claim 15 wherein said guide means include a rod member adapted at one end thereof for attachment to said broaching means and to extend forwardly thereof, and a plurality of radial fin members disposed about said rod member to provide directional stability during the pushing of said broaching means through the ground.

20. The apparatus of claim 19 wherein said rod member is adapted for attachment to the second end of said broaching means.

21. The apparatus of claim 20 wherein said fin members are rotatable about said rod member.

22. The apparatus of claim 18 including a tubular member concentrically disposed about said rod member, said tubular member being rotatable about said rod member, wherein said fin members are affixed to said tubular member to be in longitudinal alignment with said rod member.

23. An apparatus for non-rotatively forming subterranian holes between horizontally spaced locations, comprising: broaching means having a first trailing and a second leading end for cutting a core of earth; rod means releasably connectible to said first end for pushing said broaching means through the ground to cut said core of earth; guide means disposed forwardly of said broaching means for guiding the movement of said broaching means between said horizontally spaced locations; and extruding means to extrude said core of earth, wherein said broaching means and said guide means are disposed in spaced relationship about a common central member adapted at one end thereof for attachment to said rod means, said broaching means comprising first and second peripheral vanes circumferentially disposed about said shaft, said first vane being located forwardly relative to said second vane when said broaching means are being pushed through the ground, and a plurality of radial vanes extending between said central member and said peripheral vanes to support said peripheral vanes and to radially cut said core of earth as said broaching and guide means are pushed through the ground; said guide means being disposed forwardly of said broaching means and comprising a plurality of radial fin members disposed about said central member to provide directional stability during the pushing of said broaching means through the ground.

24. The apparatus of claim 23 wherein said broaching means and said fin members are rotatable about said common central member.

25. The apparatus of claims 11, 12 or 19 wherein said second peripheral member is tapered said first trailing end of said broaching means.

26. A method of non-rotatively forming holes in the ground between horizontally spaced locations including the steps of:

pushing a broaching head having a first trailing and a second leading end between the locations to cut a core, which passes through the head, said pushing being by means of rod means releasably connectible to said first trailing end;

guiding the broaching head between said spaced locations during the cutting of the core by means of co-operating guide means; and extruding said core to form the hole, the step of extruding said core including the step of reversing the orientation of said broaching head and drawing said head back along said core, whereupon the reversed head is utilized to extrude said core from the hole by at least partially closing said head to prevent the passage of the core therethrough.

27. The method of claim 26 including the step of compacting the core during the cutting thereof.

28. A method of non-rotatively forming holes in the ground between horizontally spaced locations including the steps of:

pushing a broaching head having a first trailing and a second leading end between the locations to cut a core, which passes through the head, said pushing being by means of rod means releasably connectible to said first trailing end;

guiding the broaching head between said spaced locations during the cutting of the core by means of co-operating guide means; and extruding said core to form the hole, wherein the step of extruding the core includes the step of replacing said broaching head with a second broaching head of larger diameter, reversing the orientation thereof and drawing said broaching head back into the ground to cut a larger core, whereupon the reversed second head is utilized to extrude said enlarged core by at least partially closing said head to prevent the passage of the core therethrough.

29. The method of claim 28 including the step of compacting the larger core during the cutting thereof.

30. The method of claims 26 or 28 wherein said broaching head is drawn only partially back along said core to extrude only a portion of said core at a time.

31. The method of claims 26 or 28 wherein said core is cut by forming first and second co-axial incisions whereby subsequent removal of the core is facilitated.

32. The method of claims 25, 29 or 27 wherein said core and said larger core are cut by forming first and second co-axial incisions whereby subsequent removal of the core is facilitated.

33. A broaching head for non-rotatively cutting a core of earth, comprising: a central portion; a plurality of radial ground-cutting vanes extending from said central portion; and first and second circumferential ground-cutting blades spaced from and extending around said central portion and co-axial therewith, said first blade being disposed forwardly of said second blade; and said first circumferential ground-cutting blade being spaced at a greater distance from said central portion than said second blade.

34. The broaching head of claim 33 wherein said central portion has provided on opposite ends thereof connecting means for releasably connecting said broaching means to a prime mover for pushing said broaching head through the ground, whereby said broaching head can be reversably connected to said prime mover.

35. The broaching head of claim 29 wherein said second ground-cutting blade is tapered rearwardly to compact the ground during the cutting thereof.

36. The broaching head of claim 30 wherein said central portion is hollow and has formed therein forwardly of said first circumferential blade at least one aperture for the passage of a fluid.

37. The broaching head of claim 31 including collar means slidably disposed about said central portion to alternately open and close said aperture during core extruding movements of said broaching head.

38. The broaching head of claim 32 wherein said collar means have formed thereon radially extending ground engaging means to cause said opening and closing movements of said collar means.

39. A tool for non-rotatively cutting a core of earth, comprising: a central member adapted at one end thereof for attachment to rod means for pushing said tool through the ground; and broaching means and guide means rotatably disposed in spaced relationship about said central member, said broaching means comprising first and second peripheral vanes circumferentially disposed about said central member to be unequally spaced therefrom, said first vane being located forwardly relative to said second vane when said broaching means are being pushed through the ground, and a plurality of radial vanes extending between said central member and said peripheral vanes to support said peripheral vanes and to cut said core of earth as said broaching and guide means are pushed through the ground, said guide means being disposed forwardly of said broaching means and comprising a plurality of radial fin members disposed about said central member to provide directional stability during the pushing of said tool through the ground.

40. The tool of claim 39 wherein said second peripheral vane tapers inwardly in the direction of said one end of said central member.

41. The apparatus of claim 4 wherein said central member is hollow and has formed therein forwardly of said first peripheral vane at least one aperture for the passage of a fluid.

42. The apparatus of claim 41 including collar means slidably disposed about said central member to alternately open and close said aperture during said core extruding movements of said broaching means.

43. The apparatus of claim 42 wherein said collar means have formed thereon radially extending ground engaging means to cause said collar means to slide along said central member to alternately open and close said aperture.

44. The apparatus of claim 41 wherein said peripheral vanes are hexagonally shaped for bore hole diameters ranging from 2 to 5 inches.

45. The apparatus of claim 41 wherein said peripheral vanes are dodecahedrally shaped for bore hole diameters in excess of 5 inches.

46. The apparatus of claims 44 or 45 wherein said radial and peripheral vanes are provided with beveled cutting edges.

47. The apparatus of claim 46 including a tubular member concentrically disposed about said rod member, said tubular member being rotatable about said rod member, wherein said fin members are affixed to said tubular member to be in longitudinal alignment with said rod member.

48. The apparatus of claims 4, 41 or 6 wherein said second peripheral member is tapered said first trailing end of said broaching means.

49. A method of boring holes in the ground between horizontally spaced locations including the steps of: pushing a broaching head between the locations to cut a core, which passes through the head, by forming first and second coaxial incisions, whereby subsequent removal of the core is facilitated; guiding the broaching head between said spaced locations during the cutting of the core; and extruding said core to form the hole, including the step of compacting the core during the cutting thereof, wherein the step of extruding said core includes the step of reversing the orientation of said broaching head and drawing said head back into the incision, whereupon the reversed head is utilized to extrude said core from said bore by at least partially closing said head to prevent the passage of the core therethrough.

50. A method of boring holes in the ground between horizontally spaced locations including the steps of: pushing a broaching head between the locations to cut a core, which passes through the head, by forming first and second coaxial incisions, whereby subsequent removal of the core is facilitated; guiding the broaching head between said spaced locations during the cutting of the core; and extruding said core to form the hole, wherein the step of extruding the core includes the step of replacing said broaching head with a second broaching head of larger diameter, reversing the orientation thereof and drawing said broaching head back into the ground to cut a larger core, whereupon the reversed second head is utilized to extrude said enlarged core by at least partially closing said head to prevent the passage of the core therethrough.

51. The method of claim 50 including the step of compacting the larger core during the cutting thereof.

52. The method of claims 49 or 50 wherein said broaching head is withdrawn only partially through said incised bore to extrude a portion of said core.

53. A broaching head for non-rotatively cutting a core of earth, comprising; a central portion; a plurality of radial ground-cutting vanes extending from said central portion; and first and second circumferential ground-cutting blades spaced from and extending around said central portion and coaxial therewith; said first and second circumferential ground-cutting blades being unequally spaced from said central portion, wherein said central portion has provided on opposite ends thereof connecting means for releasably connecting said broaching means to a prime mover for pushing said broaching head through the ground, whereby said broaching head can be reversably connected to said prime mover.

54. The broaching head of claim 53 wherein said second ground-cutting blade is tapered rearwardly to compact the ground during the cutting thereof.

55. The broaching head of claim 54 wherein said central portion is hollow and has formed therein forwardly of said first circumferential blade at least one aperture for the passage of a fluid.

56. The broaching head of claim 55 including collar means slidably disposed about said central portion to alternately open and close said aperture during core extruding movements of said broaching head.

57. The broaching head of claim 56 wherein said collar means have formed thereon radial ground engaging means to cause said opening and closing movements of said collar means.

* * * * *